United States Patent [19]

Holder et al.

[11] Patent Number: 4,789,406

[45] Date of Patent: Dec. 6, 1988

[54] METHOD AND COMPOSITIONS FOR PENETRATING AND REMOVING ACCUMULATED CORROSION PRODUCTS AND DEPOSITS FROM METAL SURFACES

[75] Inventors: E. Paul Holder, Spring, Tex.; Frederick C. Klaessig, Doylestown, Pa.; Pamela J. Peerce-Landers, Pottstown, Pa.; David W. Reichgott, Richboro, Pa.

[73] Assignee: Betz Laboratories, Inc., Trevose, Pa.

[21] Appl. No.: 145,658

[22] Filed: Jan. 13, 1988

Related U.S. Application Data

[63] Continuation of Ser. No. 898,961, Aug. 20, 1986, abandoned.

[51] Int. Cl.[4] ..... B08B 3/08; C23G 5/032

[52] U.S. Cl. ..... 134/3; 134/10; 134/22.14; 134/22.16; 134/28; 134/41; 252/81; 252/85; 252/87; 252/105

[58] Field of Search ..... 134/2, 3, 10, 22.14, 134/22.16, 22.19, 28, 41; 252/81, 82, 83, 85, 87, 105

[56] References Cited

U.S. PATENT DOCUMENTS

| | | | |
|---|---|---|---|
| 2,472,684 | 6/1949 | Rossi | 252/105 |
| 2,806,060 | 9/1957 | Bersworth et al. | 252/DIG. 11 X |
| 3,272,738 | 9/1966 | Pitzer et al. | 252/81 |
| 3,297,580 | 1/1967 | Pitzer | 252/142 |
| 3,447,965 | 6/1969 | Teumac | 134/22.19 X |
| 3,753,924 | 8/1973 | Frenier | 252/83 X |
| 3,956,164 | 5/1976 | Walker et al. | 252/82 X |
| 4,279,768 | 7/1981 | Busch | 252/81 X |
| 4,404,039 | 9/1983 | Osberghaus et al. | 134/28 X |
| 4,430,128 | 2/1984 | Frenier et al. | 134/41 X |
| 4,481,040 | 11/1984 | Brooker et al. | 134/28 X |
| 4,598,527 | 6/1986 | Gipp | 252/DIG. 11 X |
| 4,610,728 | 9/1986 | Natesh et al. | 134/28 X |
| 4,623,399 | 11/1986 | Frenier | 252/82 X |
| 4,636,327 | 1/1987 | Frenier et al. | 252/87 |

FOREIGN PATENT DOCUMENTS

| | | | |
|---|---|---|---|
| 791092 | 7/1968 | Canada | 134/41 |
| 1073826 | 1/1960 | Fed. Rep. of Germany | 252/87 |
| 489800 | 2/1947 | Switzerland | 252/105 |

OTHER PUBLICATIONS

"Measurement of Crystalline and Amorphous Iron Removal in Soils", S. Pawluk, *Canadian Journal of Soil Science*, vol. 52, 119–123, 1972.

"Use of Oxalate for Fe Extraction from Soils", U. Schwertmann, *Canadian Journal of Soil Science*, vol. 53, pp. 244–246, 1973.

"Iron Oxide Removal from Soils and Clays by a Dithionite-Citrate System Buffered with Sodium Bicarbonate", O. P. Mehrs and M. L. Jackson, *National Conference of Clay and Clay Minerals*, vol. 7, pp. 317–327, 1960.

*Industrial Cleaning Manual*, published by National Association of Corrosion Engineers, pp. i–38.

*Chemical Engineers' Handbook*, R. H. Perry and Chilton, 5th Edition, Mc-Graw-Hill, New York, N.Y., pp. 18–78 to 18–81, 1973.

"Leaching of Metal Oxides", Warren and Devuyst, Organization of the Second International Hydrometallury Symposium, pp. 229–265, 1973.

"FCC Cooling", *Oil and Gas Journal*, Oct. 17, 1983, pp. 132–133.

*Primary Examiner*—Asok Pal

*Attorney, Agent, or Firm*—Alexander D. Ricci

[57] ABSTRACT

Methods for removing iron oxide and other accumulated corrosion products from metal surfaces in contact with aqueous systems, such as cooling water systems, are disclosed. The method steps can be performed without requirement of system shutdown and without requirement of acidic conditions. The methods comprise contacting the corroded surface with an organic reductant/chelant and an inorganic reducing agent while the pH of the aqueous system is maintained within the substantially neutral range of about 6.5–7.5. Pyrogallol and methyl gallate may be used as the organic reductant/-chelant.

2 Claims, No Drawings

METHOD AND COMPOSITIONS FOR PENETRATING AND REMOVING ACCUMULATED CORROSION PRODUCTS AND DEPOSITS FROM METAL SURFACES

This is a continuation of co-pending application Ser. No. 898,961 filed on Aug. 20, 1986, now abandoned.

FIELD OF THE INVENTION

The present invention is directed toward methods and compositions for penetrating and removing accumulated corrosion products and deposits, such as iron oxide deposits, from metal surfaces such as those in contact with cooling water systems.

BACKGROUND OF THE INVENTION

Metal surfaces, such as those encountered in industrial heat exchangers, are subject to accumulated corrosion product formation and deposit formation. Typically, in cooling water systems, accumulations of iron oxides are troublesome in that they reduce heat transfer efficiency of heat exchangers and the like. In many instances, these deposits must be mechanically cleaned when they are present in excessive amounts. The present invention is directed toward methods and compositions for chemically cleaning iron oxides, as well as other corrosion by-products and deposits, from metal surfaces, particularly from heat exchange surfaces in cooling water systems. The methods of the present invention provide significant improvement over the traditionally employed cleaning methods in that, in accordance with the present invention, cleaning treatment may be made when the system is still operating. Moreover the methods are performed without requiring pH depression of the system.

PRIOR ART

Most currently practiced cooling system chemical cleaning procedures for removing iron corrosion deposits require depression of the system pH to acid range (e.g., 3–5) for several hours or several days. In such cleaning approaches, although deposit removal may be effected, high corrosion rates are experienced by reason of the maintenance of low pH during the process. For instance, in U.S. Pat. No. 4,190,463 (Kaplan), iron oxide deposits are removed from heat transfer systems by first contacting the deposits with an aqueous solution of a hydrolyzable tannin extract followed by subsequent use of dilute solutions of citric acid. The pH of the cooling system water should be maintained at a pH of about 2.8–3.0 during the citric acid addition step. At column 7, line 15 of the U.S. Pat. No. 4,190,463, it is stated that use of citrates at higher pH's for long times are not effective for removing modified deposits.

In U.S. Pat. No. 3,297,580 (Pitzer), substantially neutral pH chemical cleaning compositions and methods are disclosed. These compositions and methods are directed toward removing oxide films from iron and ferrous alloys in inaccessible places. The cleaning compositions that are employed have a pH range of between 6.5 and 9.5 and involve utilization of buffered aqueous solutions of hydrazine and polycarboxylamine acid chelating agents. The preferred metal oxide is magnetite ($Fe_3O_4$) and the preferred temperatures are 90° to 100° C. The presence of hematite ($Fe_2O_3$) and other nonmetallic oxides in industrial systems and the normal system operating temperatures may have discouraged this approach.

The concerted action of certain reductants and complexing agents has been used to extract metals from their oxides and soils. See, for instance, "Measurement of Crystalline and Amorphous Iron Removal in Soils", S. Pawluk, *Can. J. Soil Sci.*, 52, 119–123, 1972; U. Schwertmann "Use of Oxalate for Fe Extraction From Soils", *Can. J. Soil Sci.*, 53, 244–246, 1973; and O. P. Mehrs and M. L. Jackson "Iron Oxide Removal From Soils and Clays by a Dithionite-Citrate System Buffered with Sodium Bicarbonate", *National Conference of Clays and Clay Minerals*, 7, 317–327, 1960. Although the aforementioned use of reductants and complexing agents has been used to extract metals from soils and from their oxides, this technology has never been applied to deposit removal in open cooling systems. Anticipated severe reductant losses due to reaction with oxygen may have discouraged this approach.

DETAILED DESCRIPTION OF THE INVENTION

In accordance with the present invention, a method for penetrating and removing accumulated corrosion products and deposits, such as iron oxides encountered in cooling water systems, is disclosed. The method comprises first pretreating the corrosion products and deposits by contacting the affected metal surfaces with an aqueous solution comprising an organic reductant/chelant selected from the group consisting of pyrogallol and methyl gallate. The pH of the system water is maintained within a substantially neutral range of from about 6.5 to about 7.5 throughout the entire program, thus minimizing the potential for corrosion which exists in many of the prior art treatment approaches utilizing low acid pH's for the cleaning methods. During this pretreatment step, a complexing agent, adapted to complex with iron ions in the solution, is also added. Such complexing agents comprise members selected from the group of carboxylic acid chelants and amino carboxylic acid chelants. In addition, during the pretreatment step, deposit conditioning is enhanced by addition of small amounts of another reducing agent; preferably an inorganic reducing agent.

Exemplary complexing agents comprise ethylenediaminetetraacetic acid and water-soluble salt forms thereof, nitrilotriacetic acid and water-soluble forms thereof, sodium citrate and ethanol diglycine. Based upon present studies, the use of ethanol diglycine is preferred because of its highly superior specificity for iron.

The pretreatment step is carried out for a time sufficient for the organic reductant/chelant to reduce and/or complex the accumulated corrosion product or deposit. In the pretreatment step, the deposit is softened and converted into a form which is soluble in the circulating system water, e.g., cooling water. Typically, it is thought that pretreatment will be complete within a 24 hour period. During the pretreatment step, the methyl gallate or pyrogallol or mixtures thereof is added in an amount of from about 25 to 500 ppm with the preferred concentration being within the range of 200 to 350 ppm. The additional reducing agent is preferably an inorganic reducing agent and is added in an amount of from about 100–300 ppm.

Following the pretreatment period, the organic reductant/chelant concentration is decreased to a level not exceeding 200 ppm and the inorganic reducing agent is increased to a concentration of about 300 to 2000 ppm. Exemplary inorganic reducing agents comprise ammonium bisulfite, sodium sulfite, sodium dithionite, nitrites, and hydrazine. In preliminary laboratory tests, use of sodium sulfite led to metallurgy pitting problems. At present, ammonium bisulfite is preferred for use as the inorganic reducing agent. The inorganic reducing agent reduces any remaining iron ions in solution left as a result of the pretreatment step, and, at the same time, regenerates the organic reductant/chelant (i.e., methyl gallate or pyrogallol). This newly generated methyl gallate or pyrogallol is now free to attack any underlying deposit which was not complexed during the pretreatment period. This second step in the method, known as the deposit removal phase, is continued for a period of time from about three to seven days until the deposits and accumulated corrosion products are sufficiently removed from the affected metallic surfaces.

In addition to use of the aforementioned complexing agent during the pretreatment step, the complexing agent is also desirably added during the deposit removal phase. In both the pretreatment and deposit removal phases, the complexing agent may be present in an amount of from 100 to 1000 ppm, with 200 to 300 ppm being preferred.

In order to minimize possible loss of the organic reductant/chelant and the inorganic reducing agent due to reaction with dissolved oxygen, nonionic and/or anionic surfactants are preferably maintained in the system during both the pretreatment and the deposit removal phase. At present, it is preferred to use a nonionic surfactant, e.g., Triton BG-10, which is a glucoside available from Rohm and Haas. However, use of the anionic surfactant Triton QS-44, an octylphenoxy polyethoxyethyl phosphate, also available from Rohm and Haas, has also proven satisfactory. Other exemplary surfactants include ethoxylated alkyl phenol ethers and the succinate-based surfactants. The surfactant should be preferably present during both the pretreatment and deposit removal phases of the cleansing methods in an amount of from 1 to 20 ppm.

It is noted that, in order for the program to be effective, the pH of the cooling water system must be maintained within the range of about 6.5 to 7.5 . If the pH is less than 6.5, the efficacy of the reducing agents is diminished; if the pH is above 7.5, the solubility of the organic reductant/complexing agent is reduced to the point that the materials may precipitate from solution. Other operating parameters have little effect on the program. However, water hardness, due to the calcium ion, should be maintained at less than about 400 ppm (as $CaCO_3$) because the use of the complexing agent, preferably ethanol diglycine, will chelate calcium as well as iron and extremely high calcium levels will therefore create an unnecessary demand for the chelant.

The methods and compositions of the invention are designed to penetrate and remove accumulated corrosion products from steel piping and heat transfer surfaces. Unlike many of the conventional cleaning methods, the method is performed with the cooling system on-line (i.e., still operating) and at substantially neutral pH. The unique ability to clean the system effectively without removing it from service can result in considerable savings in unit downtime. Many companies specializing in chemical cleaning do not offer effective on-line cleaning programs. As the cleansing method of the present invention removes iron scale at a mild 6.5–7.5 pH range, copper alloy equipment does not require isolation and corrosion occurring during the cleanup program is minimized. The present invention provides a distinct advantage over the traditional removal of iron scale accomplished via use of hydrochloric acid solutions which have the potential to cause serious damage to heat exchangers and associated valves and piping.

Although applicants are not to be bound to any particular theory of operation, in the deposit removal phase, the inorganic reducing agent is thought to release the iron from the corrosion-deposit complex in a soluble form and regenerate the organic reductant/chelant (i.e., pyrogallol, methyl gallate). The iron is maintained soluble by use of the complexing agent, preferably ethanol diglycine, and is blown down from the system. The organic reductant/chelant is also added during this deposit removal phase (at a reduced concentration due to the regeneration of same by the inorganic reducing agent) to condition any residual underlying corrosion deposits.

The following generalized procedures are recommended for use:

PRIOR TO STARTING PROGRAM

A. Stop feed of all regular treatment chemical including inhibitors, dispersants, chlorine and other oxidizing biocides, and surfactants.

B. Blow down the system as quickly and completely as possible to reduce cycles to 1.5 or less. For maximum effectiveness, calcium levels should preferably remain lower than about 400 ppm throughout the cleaning procedure.

C. Shut off blowdown.

D. Adjust the pH of the system to 6.5 to 7.5 and stay within this range throughout the scale removal program.

E. Conventional antifoaming agents may be required to control foaming, if necessary.

PRETREATMENT PHASE

A. Charge the system with from 25–500 ppm of pyrogallol or methyl gallate and with from 100 to 1000 ppm of the preferred ethanol diglycine complexing agent. An anionic or nonionic surfactant in an amount from 1 ppm to 20 ppm should also be preferably added during this phase. The water will become dark purple due to the formation of soluble iron complexes in the water. Inorganic reducing agents may also be added at this point in an amount of from 100–300 ppm.

B. Some of the free organic reductant/chelant is removed from solution as it complexes with iron tubercles and scale. The ppm treatment level of the organic reductant/chelant should be monitored once per hour initially and periodically thereafter throughout the pretreatment phase. Additional organic reductant/chelant should be shot fed as necessary to maintain the desired treatment level in the cooling water.

C. Recirculate the pretreatment program for about 24 hours. Then blow down the system to 1.5 cycles or less to reduce iron and calcium levels if required.

DEPOSIT REMOVAL PHASE—72–96 Hours' Duration

A. Shut off blowdown and adjust the pH to 6.5 to 7.5.

B. Charge the system with from 1–200 ppm of pyrogallol or methyl gallate, and with from 300–2000 ppm of the inorganic reducing agent. The preferred complexing agent, ethanol diglycine, may be added within a treatment range of from 100 to 1000 ppm, and the surfactant should be present in an amount of from 1 to 20. Also, a non-oxidizing biocide may be added at this stage as required to maintain effective microbiological control.

C. The total iron (suspended plus dissolved) in the system should be monitored for the next 48 hours and blowdown should be effected to 1.5 cycles or less when the iron concentration stops increasing or reaches a maximum value of about 200 ppm.

D. Repeat Steps A, B, and C under Deposit Removal Phase.

E. If the iron levels remain low (i.e., at or below those levels typically found in the recirculating tower water) during the next 24 hours, proceed to the final cleanup phase. If the total iron levels are still increasing after Step D (Deposit Removal Phase), blow down to 1.5 cycles or less and again perform Steps A, B, C, and D of the Deposit Removal Phase.

FINAL CLEANUP PHASE

A. Blow down approximately 2–3 system volumes as rapidly as possible.

B. Any residual purple color can be removed by shot feeding additional inorganic reducing agent to the system in an amount of from 100 to 1000 ppm.

C. When iron levels have been reduced below the maximum concentration recommended for the corrosion inhibitor program being used at the cooling system (usually about 3 ppm), the appropriate pretreatment steps should be taken and then the normal cooling water treatment program should be resumed.

EXAMPLES

Screening Studies and Preliminary Matters

DISCUSSION

Introduction

It was postulated that dissolution of corrosion products on steel exchanger tubes could be achieved by the concerted actions of an organic reductant/chelant and an inorganic reducing agent. It was desired to establish an on-line program which could be operated at a neutral or near-neutral pH for the removal of corrosion deposits from equipment constructed of iron-based alloys. The approach which was taken was to complex the deposit with an organic reductant/chelant and to regenerate the organic material with an inorganic reducing agent. Upon regeneration, the organic molecule would release ferrous iron into the water which would then be chelated with an iron specific chelant.

Approach

Various combinations of organic and inorganic reagents were screened to determine the most efficacious combination. Ideally, the organic reductant/chelant would be a good iron reductant at near-neutral conditions and the oxidized form of the reagent would then be a good iron chelant. As to the inorganic reducing agent, this compound should provide enough reducing power to regenerate the organic reductant/chelant and have an oxidation product that would be innocuous to the open aqueous system, e.g., cooling water system.

Screening of Organic Reductant/Chelants

Several organic reducing agents were screened for their ability to complex iron. These were ascorbic and isoascorbic acids; pyrogallol, methyl gallate, propyl gallate, resorcinol, catechol and phloroglucinol. Ascorbic and isoascorbic acid did not provide the iron complexing power which was needed for the cleaning. Therefore, they were dropped from further consideration.

Catechol (1,2-dihydroxybenzene or o-dihydroxybenzene) provided no complexation power as evidenced by the color of the deposit after a recirculator run was complete. Additionally, very little, if any, of the deposit was removed from the tube surface. Resorcinol (1,3-dihydroxybenzene or m-dihydroxybenzene) was the next compound to be considered in the testing. The results of this run showed that this structure also did not possess the reduction/complexation power necessary to effect good deposit removal. The deposit on the tube surface was virtually unchanged after the run and none of the iron had been removed.

Testing with phloroglucinol gave results similar to those obtained with resorcinol—virtually no conditioning of the deposit and no removal. Pyrogallol was tested and excellent results were obtained. The addition of small amounts of pyrogallol provided excellent conditioning of the deposit. Removal of the deposit during the regular treatment step provided very good results. Deposit removal was thorough and the cleaning procedure exposed base metal which was covered with a thin black layer believed to be protective magnetite.

Propyl gallate (3,4,5-trihydroxypropylbenzoate), a food-grade antioxidant, did not work well in that the deposit on the tube was more tenacious after treatment than before. In early screening of propyl gallate the lack of water solubility was thought to be the reason for its poor performance. In order to solubilize propyl gallate in water, the pH must be raised to 8.5 which leads to rapid oxidation by oxygen present in the atmosphere and in water. Later work indicated that this was not the only reason for the lack of performance. Propyl gallate solutions in a hexylene glycol-water solvent mixture, which can be prepared at neutral pH, also proved to be ineffective at removing corrosion deposits. One possible explanation for the ineffectiveness of propyl gallate is ring deactivation by the bulky propyl acetate group.

Methyl gallate (3,4,5-trihydroxymethylbenzoate) proved to give results equivalent to those obtained with pyrogallol; however, the treatment levels had to be increased due to the deactivation of the ring by the methyl ester functionality. Like propyl gallate, the methyl ester is only sparingly soluble in water; therefore, it was necessary to have a cosolvent present in the methyl gallate solutions. Solvents which were investigated included methyl, n-propyl and isopropyl alcohols and ethylene glycol. Each of these solvents was capable of dissolving sufficient methyl gallate; however, the pH had to be increased to 8 before a homogeneous solution could be achieved. Hexylene glycol was also tested as a co-solvent in the methyl gallate solutions and good results were obtained when these solutions were added to the cleaning program. Methyl gallate formulations prepared in hexylane glycol-water solvent systems are preferred for use and do not require increase in treatment pH. The presently preferred composition comprising the organic reductant/chelant is (% by wt) water 53%, hexylene glycol 40% and methyl gallate 7%. Exemplary compositions comprise (% by wt.) 1–10% pyrogallol or methyl gallate; 30–60% hexylene glycol co-solvent; and 69–30% $H_2O$.

Screening of Inorganic Reductants

In laboratory experiments with sodium sulfite solutions, severe pitting and underdeposit corrosion were noted on the deposition tubes. Corrosion coupons were also very heavily pitted when sodium sulfite was present in the system. Experiments with dithionite showed no pitting on either the deposition tubes or the coupons. While some corrosion was measured with dithionite, the lack of pitting made this the more attractive reagent. It should be mentioned that ammonium bisulfite solutions are also effective for the purpose and do not result in the pitting problem associated with the use of sodium sulfite.

Screening of Chelants

Laboratory studies demonstrated that cleaning was slow with NTA, EDTA and citrate. Ethanol diglycine (EDG) demonstrated superior iron chelating ability and hence is preferred for use.

Screening of Surfactants

Substantial reductions in dissolved oxygen levels were noted when either sodium sulfite or dithionite were added to the test waters. Dissolved oxygen (D.O.) levels decreased from 7 ppm to 0.1 ppm in a matter of seconds after the addition of the reductant. Thus, losses of reductant due to oxygen scavenging became a concern.

Work by Aida, et. al.([1]) shows that surfactants can be used to reduce oxygen transfer in fermentation reactors. It was decided to try adding surfactants to decrease inorganic reductant losses due to scavenging. Several surfactants were added individually to the test water before the addition of dithionite. In each case, the D.O. (dissolved oxygen) levels were measured before the addition of reductant and monitored throughout the cleaning. D.O. levels were found to drop initially, but would return to the 7 ppm levels after a few hours.

1. R. H. Perry and C. H. Chilton, *Chemical Engineers Handbook*, 5th Ed., McGraw-Hill, NY, pp. 18-78 to 18-81, 1973.

As can be seen later herein, the beneficial effect of the surfactant was independent of the surfactant's chemical composition. For formulation purposes, a surfactant with a high HLB and good solubility in high solids formulations was needed. Triton BG-10, a nonionic surfactant, has proven successful and is presently preferred. Triton QS-44, an anionic surfactant, octyl phenoxy polyethoxy ethyl phosphate, is also acceptable. These surfactants both have high HLB values.

The convenience, the chelant and surfactant can be combined in aqueous solution to form a single product ready for use. At present, it is preferred to use a 10:1 (wt. ratio) of chelant to surfactant in an aqueous solution. Exemplary single product chelant-surfactant products can be made within the following weight range of chelant:surfactant 15-1:1-15.

Efficacy of the Present Invention

In order to demonstrate the efficacy of the present invention in removing scale from metal surfaces, the following laboratory examples were performed.

The examples should be construed as being illustrative of the invention and should not be viewed as restricting the scope of same.

In one set of laboratory experiments, a scale evaluation test unit was employed. This unit is a non-evaporative unit designed to simulate cooling water system conditions (e.g, metallurgy, water velocity, retention time, water chemistry).

The following procedures were performed:

I. CORROSION

Preparation of Test Water for Corrosion

1. To 12 liters of DI water add:
   a. 200 ppm Ca as $CaCO_3$ (22 ml 1M $CaCl_2.2H_2O$)
   b. 80 ppm Mg as $CaCO_3$ (22 ml 0.4M $MgSO_4.7H_2O$)
   c. 115 ppm M-alk as $CaCO_3$ (22 ml 1.125M $NaHCO_3$)
2. Adjust pH to 7.0±0.5. Use 0.1N NaOH and 0.1N $H_2SO_4$.
3. Circulate water at low flow rate (1-2 gpm) for approximately one to two weeks. Time may be extended if considerable corrosion buildup is desired. Since there is no continuous blowdown during this period, sump tank water should be replaced at least every three days. This will avoid any clogging of flow meters due to high iron concentrations. Water loss resulting from evaporation should also be replaced.
4. Adjust heating fluid solution (ethylene glycol base) to 135° F. This fluid should circulate through the test heat exchange tubes in all phases of the program at a flow rate of about 1-2 gpm.
5. Upon completion of the corrosion phase, heat exchange tubes should be taken down, weighed (if applicable) and photographed.

II. PRETREATMENT

During this phase, higher levels of chemical treatment are added to the system. This is essential due to the high consumption of chemical that takes place initially. A pretreatment phase also facilitates deposit removal during the standard application of the program.

In cases where continuous blowdown is desired, synthetic water and treatment are placed in makeup tanks positioned below the units. These makeup solutions are continuously fed to the sump tank by peristaltic pumps with overflow from the sump serving as blowdown. Retention rates can be regulated by adjusting feedrate.

Air-sensitive treatments such as methyl gallate and sodium dithionite are fed via 50 cc syringes using Sage Model 341A syringe pumps.

Preparation of Test Water Pretreatment Phase

1. To 12 liters of DI water add:
   a. 200 ppm Ca as $CaCO_3$ (22 ml 1M $CaCl_2.2H_2O$)
   b. 80 ppm Mg as $CaCO_3$ (22 ml 0.4M $MgSO_4.7H_2O$)
   c. 115 M-alk as $CaCO_3$ (22 ml 1.125M $NaHCO_3$)
2. Begin circulating water and adjust pH to 7.0±0.5.
3. Continue to add the following:
   d. 25-500 ppm Organic Reductant (e.g., Methyl Gallate, Pyrogallol)
   e. 100-300 ppm Inorganic Reductant (e.g., Sodium Dithionite, Ammonium Bisulfite)
   f. 100-1000 ppm of the chelant (e.g., ethanol diglycine) and 1-20 ppm of the surfactant.
4. Water analysis should be conducted at startup and continual monitoring should be done during the program. Analysis should include iron, M-alkalinity, chloride, calcium, sulfite, surfactant, chelant and organic reductant. Maintain levels at ±25 ppm range, shot feeding when necessary.
5. At end of pretreatment phase, replace sump water with clean DI water.

III. STANDARD TREATMENT

During this phase, organic reductant levels are lowered and inorganic reductant levels raised.

Preparation of Test Water for Deposit Removal Phase (DRP)

1. To 12 liters of clean DI water add:
   a. 200 ppm Ca as $CaCO_3$ (22 ml 1M $CaCl_2.2H_2O$)
   b. 80 ppm Mg as $CaCO_3$ (22 ml 0.4M $MgSO_4.7H_2O$)

c. 115 M-alk as $CaCO_3$ (22 ml 1.125M $NaHCO_3$)

2. Begin circulating water and adjust pH to 7.0±0.5.
3. Slowly add the following, adjusting pH as needed:
   a. 1–20 ppm Surfactant (e.g., Triton QS-44, Triton BG-10)
   b. 100–1000 ppm Chelant (e.g., Ethanol Diglycine, EDG)
   c. 1–200 ppm Organic Reductant (e.g., Methyl Gallate solution)
   d. 300–2000 ppm Inorganic Reductant (e.g., Ammonium Bisulfite solution)
4. Allow to circulate for approximately five days. Variables such as nature and quantity of deposit will govern the time of the treatment application.
5. As methyl gallate concentrations are reduced to less than 50 ppm by consumption, shot feed to increase levels to around 100–150 ppm. The inorganic reducing agent should also be replenished in a similar fashion when bisulfite concentration is reduced to less than 500 ppm. Chelant and surfactant levels are maintained proportionally to methyl gallate levels.

Using the above treatment steps, the following experimental runs were performed.

TABLE I

All experimental runs consisted of the following scheme:
1. Corrosion, followed by deposit removal through
2. Chemical pretreatment
3. Standard treatment

CORROSION PHASE

| | |
|---|---|
| HEAT TRANSFER SURFACE: | 316 Mild Low Carbon Steel |
| WATER TYPE: | 200 ppm Ca as $CaCO_3$; 80 ppm Mg as $CaCO_3$; 115 ppm M-alk as $CaCO_3$ |
| TEMPERATURE, pH: | 105–120° F., pH 6.5–7.5 |
| TIME: | Two to three week period<br>Note: Time period is dependent on degree of corrosion buildup. |

| RUN NO. | TREATMENT PARAMETERS | RESULTS |
|---|---|---|
| 1 | 300 ppm Pyrogallol<br>600 ppm Sodium Dithionite<br>300 ppm EDG (ethanol diglycine)<br>2 ppm Surfactant (Triton X-100, nonionic surfactant, octylphenoxy polyethoxy (9–10 mol.) ethanol)<br>pH 6.5–7.5; Temp. 105–115° F.<br>Time: 13 hours | Water darkened to a dark purple color after 20 minutes, deposit was loose and flaky. Appearance of deposit became black. Base metal was clearly visible. |
| 2 | 300 ppm Pyrogallol<br>600 ppm $NH_4HSO_3$<br>300 ppm EDG<br>2 ppm Surfactant (Triton X-100)<br>pH 6.5–7.5; Temp. 105–115° F.<br>Time: 13 hours | Water darkened to a dark purple-black color after 5 minutes, deposit was flaky, some residual deposit remained on tube. |

Observations: After drying tubes, both programs removed roughly the equivalent amount of deposit. Run 1 was able to attack and remove more tenacious deposits.

| | | |
|---|---|---|
| 3 | 25 ppm Pyrogallol<br>300 ppm Sodium Dithionite<br>200 ppm EDG<br>5 ppm Surfactant (Triton QS-44 anionic surfactant - octylphenoxy polyethoxyethyl phosphate)<br>pH 6.5–7.5; Temp. 115–120° F.<br>Time: 25 hours | Same as Run 1 |
| 4 | 25 ppm Pyrogallol<br>300 ppm Sodium Dithionite<br>200 ppm EDG<br>5 ppm Surfactant (Astro-wet X-805)<br>pH 6.5–7.5; Temp. 115–120° F.<br>Time: 25 hours | Water and deposit darkened after 30 minutes. Deposit was soft and flaky. No clean surface visible on this tube. |

Observations: Dissolved oxygen levels were monitored during this set of experiments. It was apparent that the use of a surfactant minimized reductant losses due to oxygen scavenging and that this beneficial effect was independent of the type of surfactant used. Lower treatment levels can thus be maintained without loss in efficacy.

| | | |
|---|---|---|
| 5 | 500 ppm Pyrogallol (initial eight hours)<br>25 ppm Pyrogallol (remainder of program)<br>300 ppm Sodium Dithionite<br>200 ppm EDG<br>5 ppm Surfactant (Triton QS-44)<br>pH 6.5–7.5;<br>Temp. 115–120° F.<br>Time: 72 hours | Deposit darkened after five minutes. Almost all deposit was removed during the initial eight hours. Surface remained clean for remainder of program. |
| 6 | 300 ppm Methyl Gallate (initial 24 hours)<br>100 ppm Methyl Gallate (remainder of program)<br>300 ppm Sodium Dithionite<br>200 ppm EDG<br>10 ppm Surfactant (Triton QS-44) | Deposit was very soft and flaky with base metal visible. |

-continued

| |
|---|
| pH 6.5–7.5; Temp. 115–120° F. Time: 96 hours |

COMPARATIVE TEST

A corroded mild steel tube was exposed to 250 ppm tannic acid for several hours. During this time, the deposit changed from brick-red to a deep purplish-black color. This purple-black material was presumably the ferric tannate complex. The tube was then dried in the oven for 10 minutes at 70° C. The dry deposit was jet black and so loosely adherent that it could be removed by gently blowing on it. The tube was then replaced in a scale evaluation test unit as described above for additional treatment. However, when water circulation was begun, the black material was stripped from the tube. No further treatment was required.

Tannic acid is interesting because it possesses both the reducing and complexing functions in the same molecule. Unlike the methods of the present invention, tannic acid seemed to undermine the deposit more than dissolve it. Treatment with tannic acid changed the composition of the corrosion deposit. The resulting deposit was softer and much less adherent, but still largely remained on the tube until it had been dried. In contrast, the various reducing agent/complexing agent mixtures of the present invention which were tried, e.g., EDG/sulfite, dissolved the red, iron oxide deposit. Residual deposits retained their original tenacity.

FIELD TEST

A Southwestern chemical plant using well water makeup for its cooling system was chosen as the test site. This plant was being treated with a polymeric based scale control and corrosion inhibiting treatment. The plant produces specialty chemicals, and there are no brass or copper heat exchangers. The majority of the heat exchangers were stainless steel with a few LCS exchangers and LCS transfer lines. The two exchangers which were involved in our evaluation were small LCS exchangers which had not been opened for some time. The tower which fed those two LCS exchangers had a system volume of approximately 50,000 gallons with a six week to six month (depending on the heat load) retention time.

DISCUSSION

The initial days of the trial were hampered by several mechanical problems, but these had been solved by the third day and the mechanics of the trial went smoothly after that. After we had started pretreatment with the high levels (350 ppm) of methyl gallate, we found out that the valve to the exchangers was still not functional and no water was flowing through the exchangers. Therefore, the only iron which was being conditioned by the chemicals was that in the transfer lines. We did notice, however, a change in color of the tower water from clear to a slight brown color the first day, indicative of the reaction of methyl gallate with residual oxygen in the tower water. This confirmed our observations from previous runs in the laboratory. Also on the first day we demonstrated that the integrity of the ammonium bisulfite could be maintained in an open recirculating system (through residual bisulfite testing) and that reaction of bisulfite with oxygen in the open recirculating water could be inhibited in the presence of Triton BG-10.

Flow through the LCS exchangers was initiated the second day and the tower turned dark purple as the methyl gallate complexed with the iron.

On the third day of the trial, pretreatment was stopped but we did not blow down as originally specified based on our laboratory work. The methyl gallate levels measured in the tower were around 200 ppm and were allowed to gradually decrease during the cleaning phase. As specified in the procedure, the ammonium bisulfite level was increased to release and reduce the methyl gallate. The tower maintained its dark purple color throughout the cleaning process.

The fifth day of the trial we purposely blew down the tower and then fed the treatment components (i.e., methyl gallate, ethanol diglycine, ammonium bisulfite, and surfactant) again and reinitiated the cleaning process. The tower was in good mechanical control at this point and we were able to track iron levels very well.

Also during the field trial we were not able to achieve the theoretical levels of methyl gallate in the tower during the pretreatment period. We wanted a 350 ppm active methyl gallate level during this time, but the maximum that could be achieved was 200 ppm active even when a 20% excess of the product was fed. It is possible that some of the material was complexing with iron on transfer line surfaces and not returning to the tower or the insolubility of the material in the drums may have reduced the actual amount added to the tower. It is also possible that certain contaminants in the water caused interferences in our methyl gallate test procedure. Another and perhaps better explanation for this effect was the pH of the tower water during the first 36 hours of the trial. During this time, the plant's acid feed equipment was malfunctioning and the tower pH remained steady at 8.0. We have shown in the laboratory that a pH above 7.5 causes significant degradation of methyl gallate.

SUMMARY AND CONCLUSION FROM FIELD TRIAL EVALUATION

Overall, the first field evaluation of the On-line Cleaning Program was successful.

In addition to cleaning exchangers, an objective of the field evaluation was to determine if an open recirculating cooling system could be operated with a reducing environment. While the actual OR potentials were not measured during the trial, we were able to maintain the integrity of the chemicals in solution (ammonium bisulfite and methyl gallate) which implies that the tower must have been operating with a reducing environment present.

The soluble iron levels in the tower during the trial increased significantly from an initial level of less than 0.5 ppm to 20 ppm at one point during the evaluation. These levels are lower than we initially anticipated, but there is not a lot of LCS in this system (the exchangers are small).

The tower which had been disinfected of all MB growth prior to the initiation of the trial showed no evidence of any biological growth during the eight day evaluation.

Clean LCS coupons, which were placed in a bypass rack on the first day, showed no evidence of pitting corrosion, and calculations indicate that the overall increase in corrosion experienced by the LCS equipment was 0.8–0.9 mpy even though no corrosion protection was present in the tower during the trial period. Stainless steel coupons are routinely used to monitor the system and no detrimental effect was seen on these during the trial. Admiralty coupons were not used.

In addition to the positive aspects noted above, some problems were also encountered during the trial. One of the most significant and most bothersome problems for us was the insolubility of methyl gallate in the formulation. All twelve drums of this product had significant amounts of undissolved methyl gallate and we had to stir the drums and often add tower water to the drums to transfer all of the solid material to the tower. The methyl gallate dissolved in the circulating tower water and reacted as it should as evidenced by the iron removal and the color of the water. It is difficult to say, however, whether the maximum efficacy was achieved. This problem has directed us to include about 40% wt. of the hexylene glycol co-solvent in the methyl gallate solution (7%) methyl gallate) to enhance the solubility of the latter.

Following the first day of the trial, the plant experienced difficulty maintaining a constant water level in the tower. As a result, a very low water level resulted the first night, causing a concentration of the treatment chemicals. The next morning all of the chemicals had been lost from the tower due to heavy foaming which occurred because of concentrating the surfactant and other chemicals. Plant operators had been instructed by senior plant personnel not to add any chemicals to the tower during our trial and therefore no antifoam was added to remedy the foaming problem. Attempts by plant operators to overcome the low water level during the next 24 hours resulted in overfilling the tower and again, some of the treatment chemicals were lost from the tower basin. These level problems caused fluctuations in iron levels during the pretreatment period. These readings fluctuated from less than 10 ppm to as high as 20 ppm, making it impossible to track the amount of iron actually present in the tower during the initial stage of the trial. After the third day of the trial, this problem was corrected and total iron levels in the tower began to increase steadily as we expected.

Pre-corroded coupons were installed on the cold return line of the tower during the trial. Approximately 50% of the deposit on these non-heated surfaces was removed. The fact that more of this deposit was not removed may be indicative of the need for some thermal input to achieve maximum efficacy from the cleaning program.

In accordance with the patent statutes, the best mode of practicing the invention has been herein set forth. However, it will be apparent to those skilled in the art that many modifications can be made without departing from the spirit of the invention. It is to be understood that the scope of the invention is limited solely by the scope of the appended claims.

We claim:

1. A method of removing accumulated iron oxide deposits from the metal surfaces in contact with the water of a cooling water system while leaving a protective metal layer intact, said method occurring without shutting the cooling water system down and comprising the steps of:

a. maintaining the pH of said water within the range of from about 6.5 to about 7.5 throughout the entire method;

b. pretreating said surfaces by adding from about 25–500 ppm of an organic reductant/chelant selected from the group consisting of pyrogallol and methyl gallate to said cooling water, based upon one million parts of said cooling water, for a time sufficient to reduce or complex the iron in said deposits, thereby softening and converting said deposits into a water soluble form;

c. subsequently contacting said surfaces with from about 100–2000 ppm of an inorganic reducing agent adapted to reduce any remaining iron ions and, at the same time, regenerate said organic reductant/chelant;

d. maintaining from about 1 to 20 ppm of a surfactant in said water during both said steps (b) and (c) to reduce losses of said organic reductant/chelant and said inorganic reducing agent, and e. blowing down said cooling water to remove said soluble deposits.

2. A method as recited in claim 1 wherein said inorganic reducing agent is a member or members selected from the group consisting of sodium sulfite, ammonium bisulfite and sodium dithionite.

* * * * *